US007461641B1

(12) United States Patent
Styles et al.

(10) Patent No.: US 7,461,641 B1
(45) Date of Patent: Dec. 9, 2008

(54) EGR COOLING SYSTEM WITH MULTIPLE EGR COOLERS

(75) Inventors: Daniel Joseph Styles, Canton, MI (US); John William Hoard, South Lyon, MI (US); Julia Giuliano, Saline, MI (US); Robert Hornblower Meyer, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/874,449

(22) Filed: Oct. 18, 2007

(51) Int. Cl.
*F02B 47/08* (2006.01)
*F02B 47/10* (2006.01)

(52) U.S. Cl. ..... 123/568.12; 60/605.2

(58) Field of Classification Search ..... 123/568.12, 123/568.11, 568.15, 41.31; 60/605.2, 274, 60/278, 286; 165/158, 178
See application file for complete search history.

(56) References Cited

U.S. PATENT DOCUMENTS

| | | | | |
|---|---|---|---|---|
| 5,440,880 | A | 8/1995 | Ceynow et al. | |
| 5,607,010 | A * | 3/1997 | Schonfeld et al. | 165/51 |
| 6,138,649 | A * | 10/2000 | Khair et al. | 123/568.12 |
| 6,244,256 | B1 | 6/2001 | Wall et al. | |
| 6,595,274 | B2 | 7/2003 | Hayashi et al. | |
| 6,976,530 | B2 * | 12/2005 | Hayashi et al. | 165/157 |
| 7,059,308 | B2 | 6/2006 | Eitel et al. | |
| 7,131,263 | B1 * | 11/2006 | Styles | 60/278 |
| 7,299,793 | B1 * | 11/2007 | Tyo et al. | 123/568.12 |
| 2004/0050374 | A1 * | 3/2004 | Aupperle et al. | 123/568.12 |
| 2005/0188965 | A1 | 9/2005 | Usui | |
| 2005/0199228 | A1 * | 9/2005 | Yamashita | 123/568.12 |
| 2005/0199229 | A1 * | 9/2005 | Eitel et al. | 123/568.12 |
| 2006/0124115 | A1 * | 6/2006 | Brookshire et al. | 123/568.12 |
| 2006/0200297 | A1 | 9/2006 | Liu et al. | |
| 2006/0231243 | A1 * | 10/2006 | Sugihara et al. | 165/158 |
| 2007/0089716 | A1 * | 4/2007 | Saele | 123/568.12 |
| 2007/0137627 | A1 * | 6/2007 | Durand et al. | 123/568.12 |
| 2007/0267000 | A1 * | 11/2007 | Raduenz et al. | 123/568.12 |
| 2007/0289581 | A1 * | 12/2007 | Nakamura | 123/568.12 |

FOREIGN PATENT DOCUMENTS

| | | |
|---|---|---|
| JP | 10306987 | 11/1998 |

* cited by examiner

*Primary Examiner*—Mahmoud Gimie
(74) *Attorney, Agent, or Firm*—Julia Voutyras; Alleman Hall McCoy Russell & Tuttle, LLP

(57) ABSTRACT

An EGR cooling system is provided. The EGR cooling system comprising a plurality of EGR coolers configured to cool the EGR to a plurality of successively lower temperatures, where at least one of the plurality of EGR coolers includes a finned EGR cooler that comprises a plurality of channels for dissipating heat in the EGR, the plurality of channels increasing heat transfer surface area while having sufficient fin spacing to avoid clogging. The EGR cooling system may further comprise a catalyst configured to remove particle matters and/or hydrocarbons from the EGR, the catalyst positioned upstream of at least one of the plurality of EGR coolers.

18 Claims, 3 Drawing Sheets

EGR COOLING SYSTEM WITH MULTIPLE EGR COOLERS

BACKGROUND AND SUMMARY

Exhaust gas recirculation (EGR) is commonly used for NOx emission control in an internal combustion engine. Without cooling, EGR may increase intake temperatures above a level that adversely affects engine operation. As a way of dealing with this issue, EGR coolers using engine coolant as a low temperature media have been used to cool EGR gas temperatures.

Some diesel engines may have large EGR cooling demands due to the large amounts of EGR needed to meet NOx emissions. In such engines, using the engine coolant alone to cool the EGR may either be inadequate or require an excessively large EGR cooler that exceeds available package space in an engine compartment. As an alternative, a standard-sized EGR cooler may be followed by an additional EGR cooler that uses a lower temperature coolant to further cool the EGR. However, one issue with the above solution is potential fouling inside the lower temperature EGR cooler when more hydrocarbons and vapor are deposited or condensed when the EGR is cooled to a lower temperature by the additional EGR cooler.

To at least partially address the issue of providing adequate cooling to engines while avoiding EGR fouling, an EGR cooling system is provided. The EGR cooling system comprising a plurality of EGR coolers configured to cool the EGR to a plurality of successively lower temperatures, where at least one of the plurality of EGR coolers includes a finned EGR cooler that comprises a plurality of channels for dissipating heat in the EGR, the plurality of channels increasing heat transfer surface area while having sufficient fin spacing to avoid clogging. The EGR cooling system may further comprise a catalyst configured to remove particle matters and/or hydrocarbons from the EGR, the catalyst positioned upstream of at least one of the plurality of EGR coolers.

In this way, the engine may provide high levels of EGR cooling, while addressing issues of EGR fouling and engine packaging. Specifically, by providing a plurality of EGR coolers that cool the EGR to successively lower temperatures, it may be possible to meet the EGR cooling demand of a high load engine without drastically increasing the size of the EGR cooling system. Further, by positioning a catalyst upstream of at least one of the plurality of EGR coolers, it may be possible to reduce EGR fouling. Likewise, by using an EGR cooler with appropriate fin spacing, it may be possible to increase heat transfer surface area within the EGR cooler package space and further increase heat dissipation to the coolant but avoid clogging due to hydrocarbon deposit build up.

DETAILED DESCRIPTION

Figure 1:
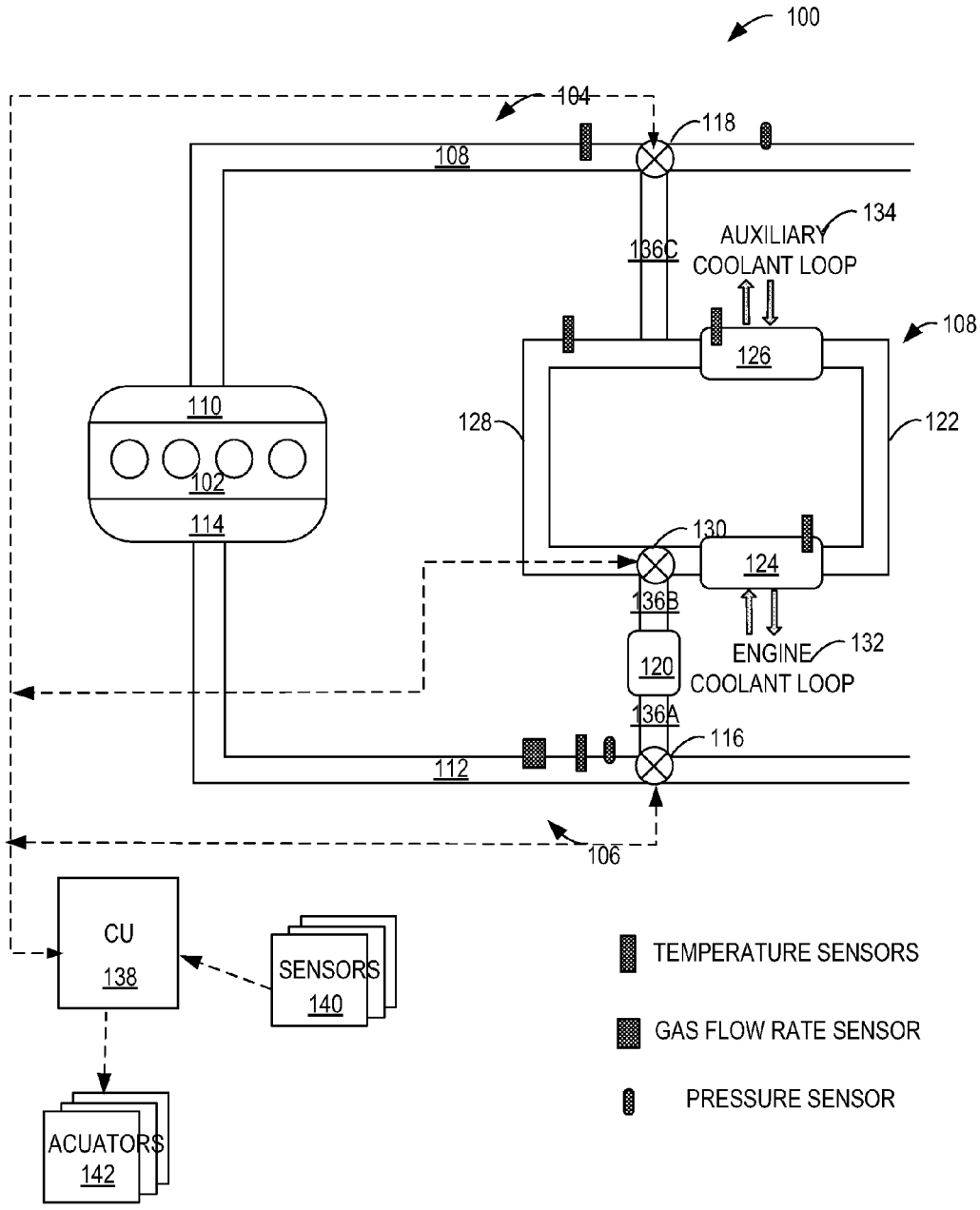
FIG. 1 illustrates an example EGR cooling system configured to meet high EGR cooling demand and reduce EGR fouling.

FIG. 1 illustrates an example EGR cooling system 100 configured to address EGR cooling demand of an engine that can operate in a wide range of engine loads, such as a turbocharged diesel engine, and in the meantime reduce EGR fouling.

The system 100 may include an engine 102 coupled to an intake system 104 and an exhaust system 106. The engine 102 may be of various internal combustion engine types, such as a diesel burning engine, a gasoline burning engine, an alternative fuel, such as bio-diesel and ethanol, burning engine, or combinations thereof.

The intake system 104 may include an intake passage 108 coupled to an intake manifold 110, which is in turn coupled to the engine 102. The exhaust system 106 may include an exhaust passage 112 coupled to an exhaust manifold 114, which is in turn coupled to the engine 102.

The EGR cooling system 100 may include an EGR valve 116 for diverting exhaust in the exhaust passage 112 as EGR, and an EGR mixer 118 for mixing the EGR with the intake air. The EGR cooling system 100 may include a catalyst 120 configured to remove particulate matters and/or hydrocarbons from the EGR.

The EGR cooling system 100 may further include a cooling loop 122 including a first EGR cooler 124 and a second EGR cooler 126 for cooling the EGR, an EGR cooler bypass 128 for bypassing the first EGR cooler 124 and the second EGR cooler 126, and an EGR cooler bypass valve 130 for controlling an amount of EGR flowing through the cooling loop 122 and/or the EGR cooler bypass 128.

The first EGR cooler 124 may be coupled to an engine coolant loop 132 and cooled by engine coolant of the engine coolant loop 132. The engine coolant loop 132 may include an engine coolant reservoir, an engine coolant pump, an engine coolant loop radiator, and one or more thermostats.

The second EGR cooler 126 may be coupled to an auxiliary cooling loop 134 and cooled by a coolant of the auxiliary cooling loop 134 having a temperature that is lower than the temperature of engine coolant of the engine coolant loop 132. The auxiliary cooling loop 134 may be a separate coolant loop separate from the engine coolant loop and may include its own coolant reservoir, coolant pump, and thermostat(s) separate from that of the engine coolant loop. However, the auxiliary coolant loop 134 may also utilize one or more components in common with the engine coolant loop, such as a reservoir, radiator, radiator airflow, etc. In some examples, the auxiliary cooling loop 134 may include a water-to-air charge air cooler.

The first EGR cooler 124 may be configured to cool the EGR to a higher temperature, for example, using an engine coolant having a temperature of approximately 95° C. The second EGR cooler 126 may be configured to cool the EGR to a lower temperature, for example using a coolant having a temperature of approximately 45° C. The use of the second EGR cooler 126 may therefore allow the EGR to achieve a lower temperature, for example approximately 50° C. lower, than if only the first EGR cooler 124 utilizing engine coolant is used. It should be noted that the above temperatures are just one example set of temperatures, and the coolant temperatures may vary with operating conditions.

In some examples, the first EGR cooler 124 may be configured to dissipate approximately 80% of the heat energy of the EGR and the second EGR cooler 126 may be configured to dissipate approximately 20% of the heat energy of the EGR. The use of the first EGR cooler 124 may therefore help to reduce overtaxing of the second EGR cooler 126.

The first EGR cooler 124 and the second EGR cooler 126 may be finned EGR coolers, each of the EGR coolers including a fin structure. Each fin structure may include a plurality of channels that increase heat transfer surface area but with sufficient fin spacing to avoid clogging that may be caused by deposition of particulate matters and hydrocarbons. For example the finned EGR coolers may have fin pitches equal to or greater than 2.5 mm. The fin shape of the finned EGR coolers may be continuous and smooth, with closed passages that provide no gas flow communication between neighboring channels.

The EGR cooling system 100 may further include various sensors, such as temperature or pressure sensors located at various locations in the EGR cooling system 100 for sensing temperature or pressure at the various locations of the EGR cooling system 100. In addition, various gas flow rate sensors may be included in the EGR cooling system 100 for sensing flow rates of gases, such as flow rates of exhaust, EGR, and intake air, at the various locations.

The EGR cooling system 100 may include various passages that couple various components of the EGR cooling system 100. For example, The EGR cooling system 100 may include a passage 136*a* that couples the exhaust passage 112 to the catalyst 120, a passage 136*b* that couples the catalyst 120 to the EGR bypass valve 130, and a passage 136*c* that couples the EGR cooler bypass 128 and the cooling loop 122 to the intake passage 108.

The EGR cooling system may be configured in such a way that a portion of the exhaust may be diverted from the exhaust passage 112 to be recirculated as the EGR. The amount or proportion of exhaust to be diverted as EGR may be determined by an engine control unit 138 based on a plurality of engine operating conditions, such as engine speed, load, etc. The amount of exhaust diverted as the EGR may be controlled by the engine control unit 138 via the EGR valve 116.

The EGR may travel from the exhaust passage 112 to the catalyst 120 via the passage 136*a* to remove particulate matters and/or hydrocarbons in the EGR and to produce a cleaned EGR gas stream. The cleaned EGR may travel to the EGR bypass valve 130 via the passage 136*b*. From the EGR bypass valve 130, the cleaned EGR may travel down the cooling loop 122 to be cooled by the first EGR cooler 124 and the second EGR cooler 126, and then to the intake passage 108 via the passage 136*c*. Alternatively, the cleaned EGR may travel down the EGR cooler bypass 128 bypassing the first EGR cooler 124 and the second EGR cooler 126 and then to the intake passage via the passage 136*c*. The EGR cooler bypass valve 130 may control the amount of EGR going down the EGR bypass 128 and/or the amount of EGR going down the cooling loop 122. The amount of EGR traveling down the cooling loop 122 and/or the EGR cooler bypass 128 may be determined by the engine control unit 138 based on EGR cooling demand. The EGR cooling demand may be determined based on the total amount of EGR to be recirculated back to the intake passage of the engine determined by the control unit 138.

The control unit 138 may be an engine control unit or may be a unit separate from the engine control unit. The control unit 138 may be coupled to various sensors 140 for receiving signals from various components of the EGR cooling system 100 and various components of an engine system. For example, the control unit 138 may receive various signals indicative of sensed temperatures from various temperature sensors in the EGR cooling system 100, such as the exhaust temperature in the exhaust passage, the EGR temperature after the portion of EGR cooled by the EGR coolers and the portion of the EGR bypassing the EGR coolers are mixed but prior to entering the intake passage, the intake temperature of intake air in the intake passage 108. The control unit 138 may also receive various signals indicative of sensed pressures from various pressure sensors in the EGR cooling system 100 and various signals indicative of valve positions from various valves, such as the EGR valve 116 and the EGR bypass valve 130.

The control unit 138 may be coupled to various actuators 142 for controlling operation of various components of EGR cooling system 100 and various components of an engine system. For example, the control unit 138 may control the operation of the various valves of the EGR system, such as controlling operation of the EGR valve 116 in diverting a proportion of exhaust as EGR, controlling operation of the EGR cooler bypass valve 130 in controlling the amount of EGR to be cooled by the plurality first and the second EGR coolers and the amount of EGR bypassing the first and the second EGR coolers.

The catalyst 120 may be various exhaust treatment systems configured to remove hydrocarbons, from the EGR. For example, it may be a self-regenerating catalyzed particulate filter that traps and oxides hydrocarbons in the EGR.

It may also be possible to provide a plurality of catalysts positioned at various locations in the EGR cooling system to remove particulate matters and/or hydrocarbons from the EGR. For example, an additional catalyst 120 may be provided in between the first EGR cooler 124 and the second EGR cooler 126.

The extent of deposition of particulate matters and/or hydrocarbons in the EGR inside an EGR cooler may be affected by the cooling temperature of the EGR cooler. A lower temperature EGR cooler that cools the EGR to a lower temperature may have more significant particulate matters and/or hydrocarbon deposition than a higher temperature EGR cooler that cools the EGR to a higher temperature. Therefore, although the catalyst 120 is positioned upstream of all EGR coolers in this example, it may be possible to position the catalyst 120 downstream of a higher temperature EGR cooler, such as the first EGR cooler 132 and upstream of a lower temperature EGR cooler, such as the second EGR cooler 134. The first EGR cooler 132 may not have significant deposition of in the EGR because of its higher cooling temperature, but the second EGR cooler 134, which may experience significant deposition of hydrocarbons from the EGR because of its lower cooling temperature.

Although in this example only two EGR coolers are provided, in other examples more than two EGR coolers may be provided. Further, while in this example the EGR coolers are arranged in series, in other examples, EGR coolers may be arranged in series, in parallel, or combinations of series and parallel, with respect to each other.

Although one EGR cooler bypass 128 is provided in this example, multiple EGR cooler bypasses may be provided, allowing the EGR to bypass one or more EGR coolers.

By providing a plurality of EGR coolers that cool the EGR to successively lower temperatures, it may be possible to meet a high EGR cooling demand of a high load engine without drastically increasing the size/packaging of an EGR cooling system.

The exhaust often contains unburned hydrocarbons, which may be deposited in an EGR cooler when the EGR is cooled to a lower temperature. The deposition of the hydrocarbons inside an EGR cooler may decrease efficiency and may cause fouling of the EGR cooler. By providing a catalyst configured to remove hydrocarbons from the EGR, the catalyst being positioned at least upstream of lower temperature EGR coolers, it may be possible to eliminate or reduce EGR fouling, at least under certain engine operating conditions when the catalyst is operating in its intended operating temperature range.

Conversely, the particulates in the exhaust are more likely to deposit in the high temperature EGR cooler if this is the first EGR cooler in series due to the higher inlet temperatures and higher thermophoresis or faster heat dissipation. In this case, it may be appropriate to place a catalyst (e.g., a particulate filter) in front of the first EGR cooler experiencing the hottest inlet gas temperatures.

By providing finned EGR coolers with appropriate fin spacing, the heat transfer surface area may be enlarged for a given package space resulting in an increased rate of heat dissipation. Further, such a configuration may avoid clogging caused by deposition of particulate matters and/or hydrocarbons, especially when the particulate filter is fully loaded and requires regeneration, or when the catalyst is not fully warmed up and oxidizing hydrocarbons.

Figure 2:
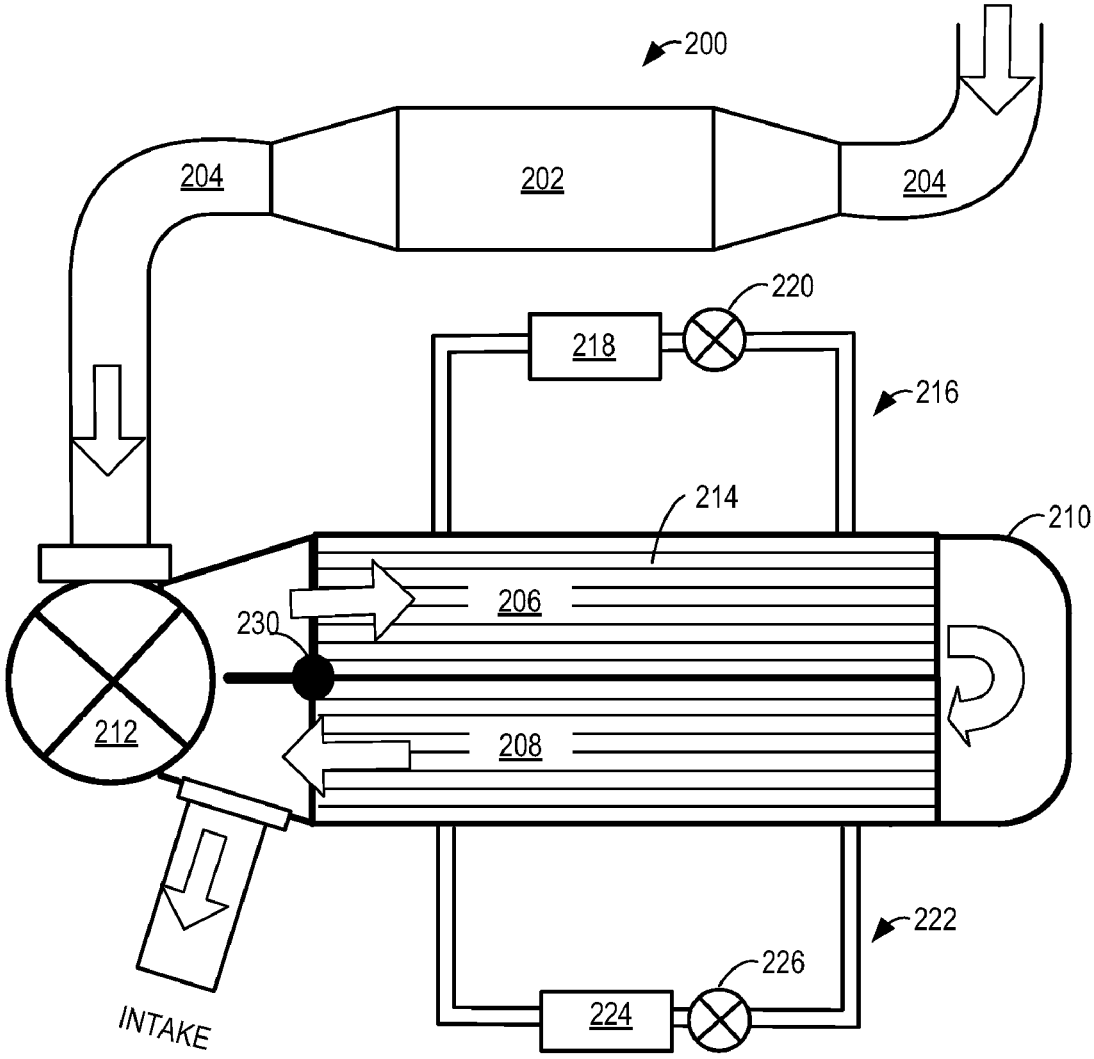
FIG. 2 illustrates another example EGR cooling system configured to meet high EGR cooling demand and reduce EGR fouling, showing the EGR coolers of the EGR cooling system being finned EGR coolers having fin structures.

FIG. 2 illustrates another example EGR cooling system 200 configured to meet high EGR cooling demand and in the mean time reduce EGR fouling. An EGR catalyst 202 is shown disposed in an exhaust passage 204 of an engine, upstream of a first EGR cooler 206 and the second EGR cooler 208. The catalyst 202 may be configured to remove particulate matters and/or hydrocarbons in the EGR. The first EGR cooler 206 and the second EGR cooler 208 are shown to be integrated into a unitary EGR cooling unit 210. The EGR cooling unit 210 is also shown to include an EGR valve 212 for diverting a portion of exhaust as EGR to be recirculated into engine intake, and an EGR cooler bypass valve 230 that allows a controlled portion of the EGR to bypass the first EGR cooler 206 and the second EGR cooler 208.

The first EGR cooler 206 and the second EGR cooler 208 are shown to be finned EGR coolers, each including a fin structure having a plurality of channels 214 for dissipating heat from the EGR, the plurality of channels 214 having sufficient fin spacing to avoid clogging, which may be a result deposition of particulate matters and/or hydrocarbons in the EGR coolers. For example, fin pitches of the fin structures may be equal to or greater than 2.5 mm in diameter, and fin shapes of the fin structures may be continuous and smooth with closed passages that provide no gas flow communication between neighboring channels of a given fin structure.

The first EGR cooler 206 is shown to be coupled to an engine coolant loop 216, the engine coolant loop 216 including an engine coolant loop radiator 218, an engine coolant pump 220, and a thermostat (not shown). The first EGR cooler 206 is cooled by coolant that circulates in the engine coolant loop 216.

The second EGR cooler 208 is shown to be coupled to a water-to-air charge air cooler coolant loop 222 including a charge air cooler radiator 224, a charge air cooler coolant pump 226, and a thermostat (not shown). The second EGR cooler 208 is cooled by coolant circulating in the charge air cooler coolant loop 222.

The EGR is first passed through the catalyst 202 to remove hydrocarbons and to produce a cleaned EGR. The cleaned EGR is first cooled to a first temperature, for example using an engine coolant having a temperature of approximately 95° C. of the first EGR cooler 204. The cleaned EGR is then cooled to a second temperature, for example using a coolant having a temperature of approximately 45° C. in the second EGR cooler. The EGR cooled to the second temperature is then mixed with the intake air at an EGR mixer (not shown). Alternatively, the EGR may directly enter the intake manifold without passing through a mixer.

The specific routines described below in the flowcharts may represent one or more of any number of processing strategies such as event-driven, interrupt-driven, multi-tasking, multi-threading, and the like. As such, various acts or functions illustrated may be performed in the sequence illustrated, in parallel, or in some cases omitted. Likewise, the order of processing is not necessarily required to achieve the features and advantages of the example embodiments described herein, but is provided for ease of illustration and description. Although not explicitly illustrated, the illustrated acts or functions may be repeatedly performed depending on the particular strategy being used, during engine operation. Further, these figures may graphically represent code to be programmed into the computer readable storage medium in a controller or control system.

Figure 3:
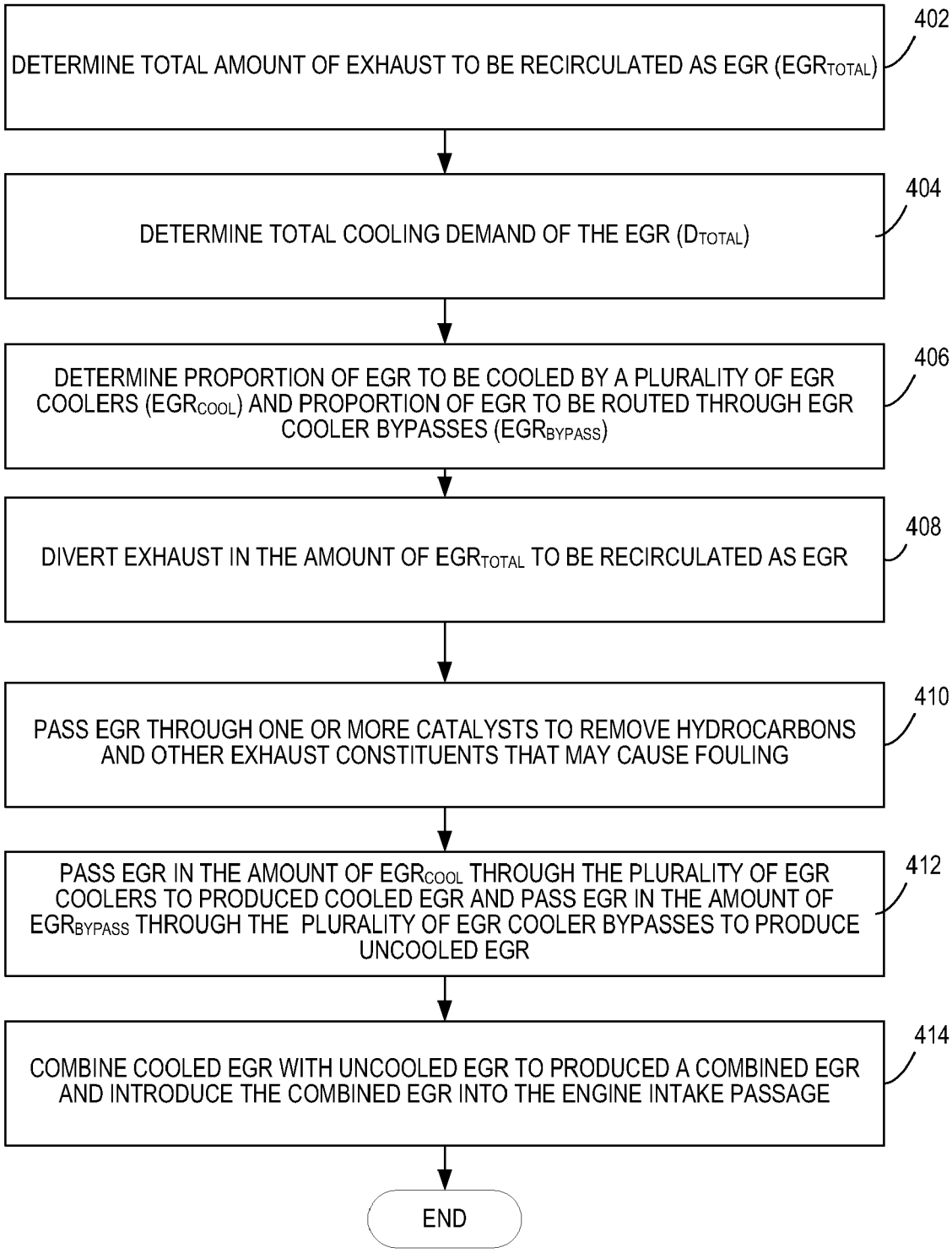
FIG. 3 is a high level flowchart illustrating a method for cooling EGR.

FIG. 3 shows a high-level flow chart of an example routine for cooling EGR of an engine that may be implemented in an EGR cooling system of FIGS. 1 and 2.

Typically at 402, the routine may determine total amount of exhaust to be recirculated back as EGR to an intake passage of the engine ($EGR_{Total}$) based on, for example, a plurality of engine operating conditions, such as engine speed and load.

At 404, the routine may determine the total cooling demand of the EGR ($D_{Total}$) based on, for example, $EGR_{Total}$ determined at 402 and an exhaust temperature ($TEMP_{Exhaust}$) sensed by an exhaust temperature sensor disposed in an exhaust passage.

At 406, the routine may determine proportion of the EGR to be cooled by a plurality of EGR coolers ($EGR_{Cool}$) and proportion of EGR to be routed through a plurality of EGR cooler bypasses ($EGR_{Bypass}$) bypassing the plurality of EGR coolers, based on for example $D_{Total}$ determined at 404.

At 408, the routine may divert a proportion of exhaust equal to or substantially equal to $EGR_{Total}$ as EGR to be recirculated back to an intake passage of the engine, via for example controlling operation of an EGR valve.

At 410, the routine may pass the EGR through one or more catalysts to remove particulate matters and/or hydrocarbons that may cause fouling in the EGR.

At 412, the routine may pass a proportion of EGR equal to or substantially equal to $EGR_{Cool}$ through the plurality of EGR coolers to produce cooled EGR and pass a proportion of EGR equal to or substantially equal to $EGR_{Cool}$ through the plurality of EGR cooler bypasses to produce uncooled EGR.

In some examples, the plurality of EGR coolers may include a first EGR cooler configured to cool the EGR to a first temperature, using for example an engine coolant having a temperature of approximately 95° C., and a second EGR cooler configured to cool the EGR to a second temperature, using for example a coolant having a temperature of approximately 45° C., the first temperature being higher than the second temperature, in some example approximately 50° C. higher.

In some examples, the routine may determine proportion of EGR to be routed through each of the plurality of EGR coolers and each of the plurality of EGR cooler bypasses.

One or more of the plurality of EGR cooler may be finned EGR coolers having fin structures that increase heat transfer surface area. The finned EGR coolers may have sufficient fin spacing to be robust to particulates and hydrocarbon deposits when the particulate filter (when used) is fully loaded and in need of regeneration or when the catalyst (if used) is not warmed up and not effective in oxidizing hydrocarbons. The fin pitch of the finned EGR cooler may be equal to or greater than 2.5 mm. The fin shape of the finned EGR cooler may be continuous and smooth with closed passages that provide no gas flow communication between neighboring channels.

In some examples, the routine may pass the EGR through one or more of the catalysts to remove particulate matters and/or hydrocarbons only prior to low temperature EGR coolers that cool the EGR to low enough temperatures that significant deposition of particulate matters and/or hydrocarbons may occur.

At 414, the routine may combine cooled EGR cooled by the plurality of EGR coolers and the uncooled EGR routed through the plurality of EGR cooler bypasses to produce a combined EGR.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An EGR cooling system for cooling EGR of an engine, comprising:

a plurality of EGR coolers configured to cool the EGR to a plurality of successively lower temperatures, including a first EGR cooler that cools the EGR to a first temperature by an engine coolant of an engine coolant loop, a second EGR cooler that cools the EGR to a second, lower, temperature by an auxiliary coolant of an auxiliary coolant loop, wherein at least one of the EGR coolers includes a finned EGR cooler that comprises a plurality of channels for dissipating heat in the EGR, the plurality of channels increasing heat transfer surface area while having sufficient fin spacing to avoid clogging;

a water-to-air charge air cooler included in the auxiliary coolant loop; and a catalyst configured to remove particle matters and/or hydrocarbons from the EGR, the catalyst positioned upstream of at least one of the plurality of EGR coolers.

2. The EGR cooling system of claim 1, wherein the first temperature is higher than the second temperature, and wherein the first EGR cooler is positioned upstream of the second EGR cooler in a path of the EGR.

3. The EGR cooling system of claim 2, wherein the engine coolant has a temperature of approximately 95° C. and the auxiliary coolant has a temperature of approximately 45° C.

4. The EGR cooling system of claim 1, wherein each of the first EGR cooler and the second EGR cooler is a finned EGR cooler that includes a plurality of channels for dissipating heat of the EGR, the plurality of channels having fin pitches equal to or greater than 2.5 mm and fin shapes being continuous and smooth with closed passages that provide no gas flow communication between neighboring channels.

5. The EGR cooling system of claim 1, wherein the first EGR cooler and the second EGR cooler are integrated into an integrated EGR cooling unit.

6. The EGR cooling system of claim 1, wherein the catalyst includes a self-regenerative particulate filter, and where the engine is a turbocharged engine.

7. The EGR cooling system of claim 6, wherein the self-regenerative particulate filter is positioned upstream of each of the plurality of the EGR coolers.

8. The EGR cooling system of claim 1 further comprising an EGR cooler bypass for bypassing the EGR through one or more of the plurality of EGR coolers.

9. The EGR cooling system of claim 8, wherein the EGR cooler bypass includes an EGR cooler bypass bypassing the EGR through all of the plurality of the EGR coolers.

10. A method for cooling EGR of an engine, comprising:

passing at least a portion of the EGR through a catalyst to remove at least some particle matters and/or hydrocarbons in the EGR; and then passing the portion of EGR through a first cooler, the first cooler having coolant at a first temperature flowing there through; and then passing the portion of EGR through a second cooler, the second cooler having coolant at a second temperature flowing there through;

dissipating heat from the portion of EGR through fins in at least one of the first and second coolers; and circulating the first coolant through an engine coolant loop, and circulating the second coolant through an auxiliary coolant loop, the auxiliary coolant loop being separate from the engine coolant loop, the auxiliary coolant loop including a charge air cooler.

11. The method of claim 10, further comprising passing the portion of EGR through at least one of the coolers under selected operating conditions.

12. The method of claim 11 where the first temperature is higher than the second temperature.

13. The method of claim 10, wherein the engine is a turbocharged engine, wherein the charge air cooler is a water-to-air charge air cooler.

14. The method of claim 13, wherein the first EGR cooler and the second EGR cooler are integrated into a unitary EGR cooling unit, and where the first EGR cooler cools the EGR using an engine coolant having a temperature of approximately 95° C. and the second EGR cooler cools the EGR using a coolant having a temperature of approximately 45° C., at least under selected operating conditions.

15. An EGR cooling system for an engine, comprising:

a water-to-air charge air cooler;

an engine coolant loop having a first coolant, the first coolant circulated through the engine;

an auxiliary coolant loop having a second coolant, the second coolant circulated through the charge air cooler as well;

an integrated EGR cooling unit that includes a first EGR cooler being coupled to the engine coolant loop, and a second EGR cooler being coupled to the auxiliary coolant loop;

an EGR cooler bypass for bypassing the integrated EGR cooling unit; and a catalyst configured to trap particulate matters and/or oxidize hydrocarbons in the EGR, the catalyst positioned upstream of the integrated EGR cooling unit and upstream of the EGR cooler bypass.

16. The system of claim 15, wherein the first coolant of the engine coolant loop is separate from the second coolant of the auxiliary coolant loop.

17. The system of claim 16 wherein the catalyst includes a particulate filter.

18. The system of claim 17 wherein the integrated EGR cooling unit includes a finned EGR cooler, the finned EGR cooler having a plurality of channels having fin pitches equal to or greater than 2.5 mm.

* * * * *